US005944569A

United States Patent [19]

Buzzi

[11] Patent Number: 5,944,569

[45] Date of Patent: Aug. 31, 1999

[54] SIMPLIFIED PROPELLING SYSTEM WITH DRIVE INTEGRAL TO EACH OTHER

[76] Inventor: Fabio Buzzi, via Per Lecco, 1-22048 Oggiono, Italy

[21] Appl. No.: 08/868,383

[22] Filed: Jun. 3, 1997

[30] Foreign Application Priority Data

Jun. 6, 1996 [IT] Italy ..... MI96A1151

[51] Int. Cl.[6] ..... B63H 23/34

[52] U.S. Cl. ..... 440/83; 440/112

[58] Field of Search ..... 440/49, 53, 82, 440/83, 111, 112

[56] References Cited

U.S. PATENT DOCUMENTS

| | | | |
|---|---|---|---|
| 2,521,368 | 9/1950 | Hingerty, Jr. | 440/83 |
| 4,832,638 | 5/1989 | Sirois | 440/112 |
| 5,100,350 | 3/1992 | Buzzi | 440/82 |

*Primary Examiner*—Jesus D. Sotelo
*Attorney, Agent, or Firm*—Herman, Gibson & Costigan, P.C.

[57] ABSTRACT

Simplified propelling system for a propeller-supporting shaft of adjustable inclination, where the front end of the propeller-supporting shaft is carried by a hollow cylindrical body steadily fixed to the reversing gearbox, which in turn is steadily fixed to the engine.

The hollow cylindrical body comes out of the stern surface of the boat through a hole sealed by rubber rings which allow small angle adjustments to modify the inclination of the propeller-supporting shaft, further carried by an adjustable support placed outside the boat; the inclination of the propeller-supporting shaft is modified by raising or by lowering a single assembly including the engine, the reversing gearbox, the hollow cylindrical body and the propeller-supporting shaft.

12 Claims, 5 Drawing Sheets

SIMPLIFIED PROPELLING SYSTEM WITH DRIVE INTEGRAL TO EACH OTHER

FIELD OF THE INVENTION

The present invention concerns a simplified propelling system with propeller drive, in particular with superficial propeller drive, particularly suitable to fast motor boats.

The end of the propeller-supporting shaft is supported by a cylindrical body, steadily fixed to the inverter, coming out of the stern surface of the boat through a hole sealed by rubber rings, preferably but not necessarily of the "O-ring" kind. Said rubber rings allow small oscillations of the engine/inverter/cylindrical body/propeller-supporting shaft complex which are particularly advantageous for superficial propeller drive, since they allow to modify the inclination of the propeller-supporting shaft in order to have an optimal working of the superficial propeller.

PRIOR ART

It is known that with fast boats with proller drive (and particularly with superficial propeller drive) it is extremely important to determine the suitable position of the propeller with respect to the water line, namely (in the case of a superficial propeller) to determine the optimal inclination of the propeller-supporting shaft coming out of the stern surface of the boat.

In fact, said position is hardly determinable in advance, because the inclination of the water flux at the outlet of the stern surface depends on several factors, among which the weight and the speed of the boat, the shape of its bottom, the state (calm, ruffled, rough, etc.) of the sheet of water on which the boat runs, etc.

Omitting the obsolete fixed transmissions, in which the inclination of the propeller-supporting shaft is modified by substituting in the dockyard the supporting trestle of the propeller-supporting shaft with another one having a different height, mobile transmissions are known to the man skilled in the art, in which the inclination of the propeller-supporting shaft is modified by means of an hydraulic ram controlled by the driver.

The Italian patent nr. 1.239.592 in the name of the applicant (and the corresponding U.S. Pat. No. 5,100,350) describes a kinetic chain for superficial propeller drive comprising, among other things, a homokinetic joint and a rotary, at least partially spherical carter (containing the thrust bearings of the propeller-supporting shaft and one or more stuffing boxes or other equivalent sealing means) which allows the propeller-supporting shaft to come out of the boat with an inclination which can be modified by acting on an adjustable support placed under the boat immediately before the propeller.

Said kinetic chain turned out to be very efficient and reliable, particularly for the propulsion of race boats, but the production costs of the homokinetic joint and of the at least partially spherical carter heavily weigh upon the costs of the whole kinetic chain. The propelling system object of the present invention does not comprise a homokinetic joint and an at least partially spherical carter. The absence of these elements, which are quite complex from a mechanical point of view, makes the propelling system according to the present invention easier to produce and cheaper, thus improving (if possible) its reliability without penalizing its efficiency.

SUMMARY OF THE INVENTION

The object of the present invention is a simplified propelling system with propeller drive (comprising at least an engine, an inverter or reversing gear box solidly linked to the engine, a propeller-supporting shaft carried by an adjustable support placed outside the boat and means for transmitting the motion from the inverter to the propeller-supporting shaft) comprising, combined together, the following elements:

- a hollow cylindrical element, integral to the carter of the inverter;
- at least a thrust bearing, placed inside the hollow cylindrical element and fitted on the propeller-supporting shaft or incorporated in the inverter;
- at least a rubber ring (preferably but not necessarily of the "0-ring" kind), placed between the external surface of the hollow cylindrical body and a toroidal element applied to a corresponding hole in the stern surface of the boat.

In a propelling system according to the present invention, the propeller-supporting shaft is linked to the outlet shaft of the inverter and the engine is supported by adjustable feet; if the the thrust bearing is incorporated in the inverter, the propeller-supporting shaft is rigidly linked to the outlet shaft of the inverter.

BRIEF DESCRIPTION OF THE DRAWINGS

The present invention will be now better described with a reference to a non-limiting embodiment shown in the alleged figures, wherein FIG. 1 schematically shows a kinetic chain for superficial propeller drive as per the prior art.

In the enclosed figures, the corresponding elements will be identified by means of the same numerical references.

DETAILED DESCRIPTION

Figure 1:
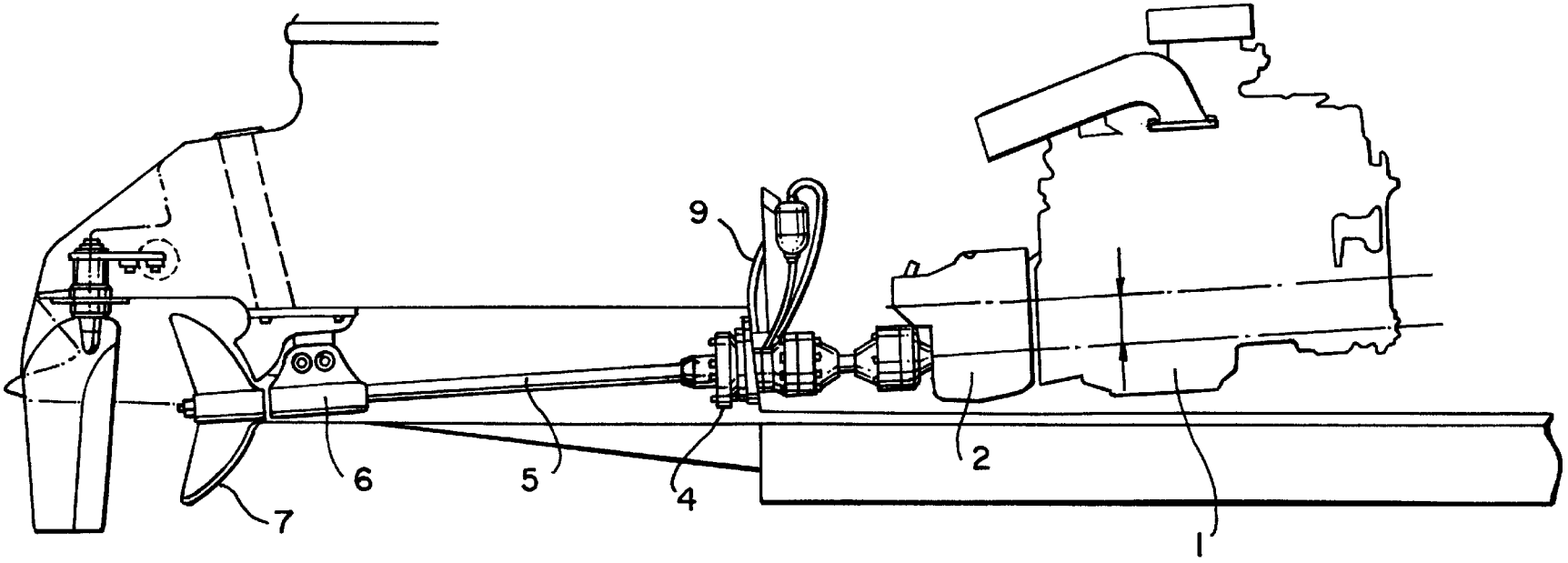

FIG. 1 schematically shows a kinetic chain for superficial propeller drive as per the prior art and, in particular, a kinetic chain of the kind described in the aforesaid Italian patent nr. 1.239.592 or in the corresponding U.S. Pat. No. 5,100,350.

FIG. 1 shows engine 1 rigidly linked to the inverter 2, the homokinetic joint, the rotary, at least partially spherical carter or box housing (containing the thrust bearings 4 of the propeller-supporting shaft 5 and a stuffing box or other equivalent sealing means) and the propeller-supporting shaft 5, coming out of the stern surface 9 with an inclination which can be modified acting on the adjustable support 6 in order to operate the superficial propeller 7 under the optimal conditions.

Figure 2:
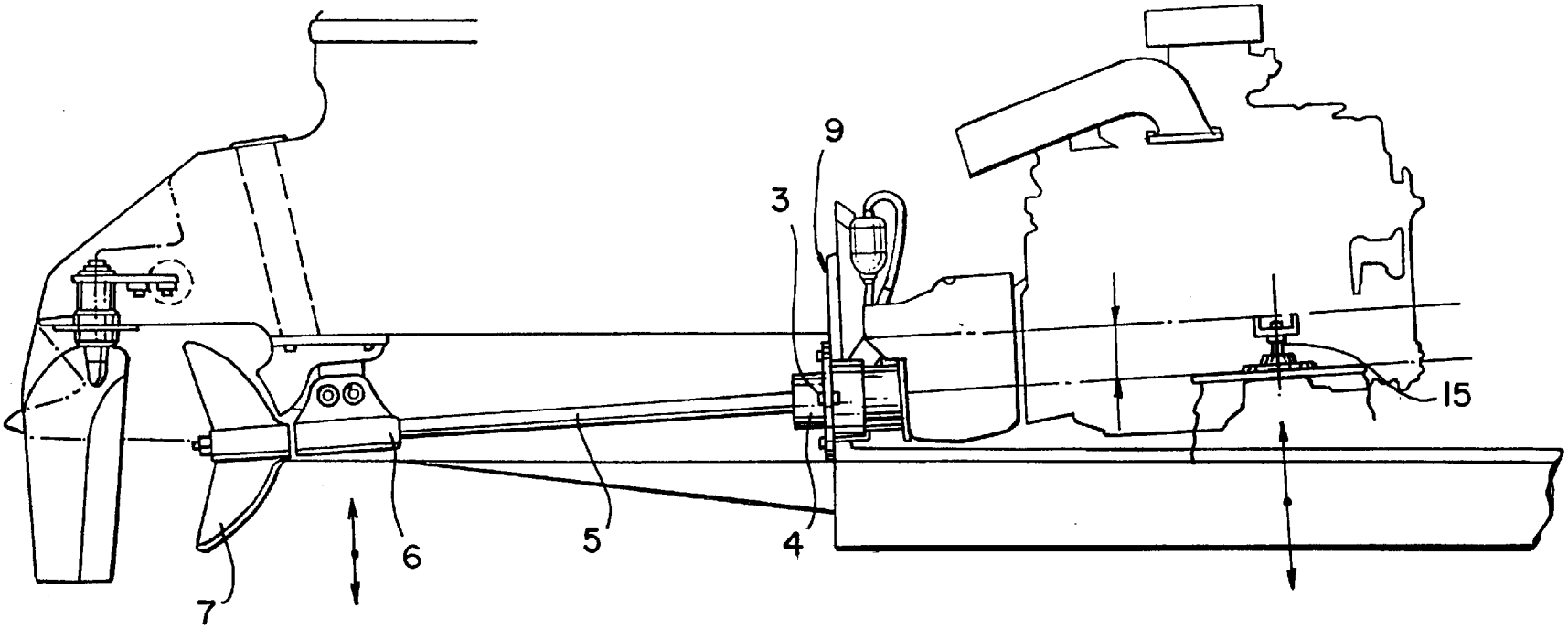
FIG. 2 schematically shows the kinetic chain for superficial propeller drive of FIG. 1 modified according to the present invention.

The elements (engine 1, inverter 2, etc.) composing the so-called kinetic chain will not be described hereinafter because they are already known and do not belong to the present invention. FIG. 2 schematically shows the kinetic chain for superficial propeller drive of FIG. 1, modified according to the invention. FIG. 2 shows that the homokinetic joint and the at least partially spherical carter were substituted by a hollow cylindrical body 3 (which will be described with a reference to FIG. 3) inside which the thrust bearings 4 of the propeller-supporting shaft 5 are placed, that the hollow cylindrical body 3 is rigidly linked to the carter of the inverter 2 and that the engine 1 is supported by adjustable feet 15 in order to align the propeller-supporting shaft 5 and the support 6.

Figure 3:
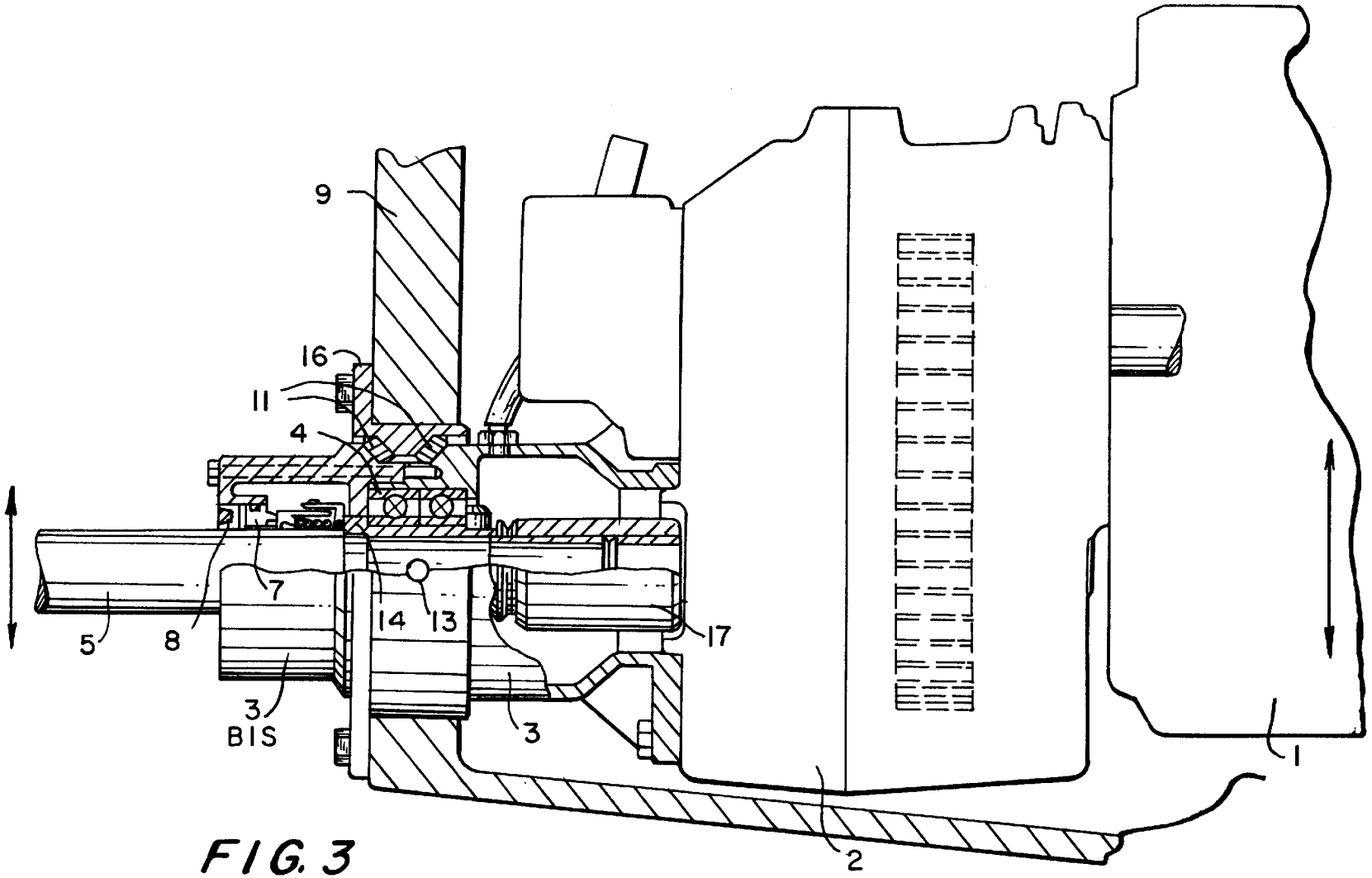
FIG. 3 shows in detail a partial cross-section of the hollow cylindrical body 3 of FIG. 2.
Figure 4:
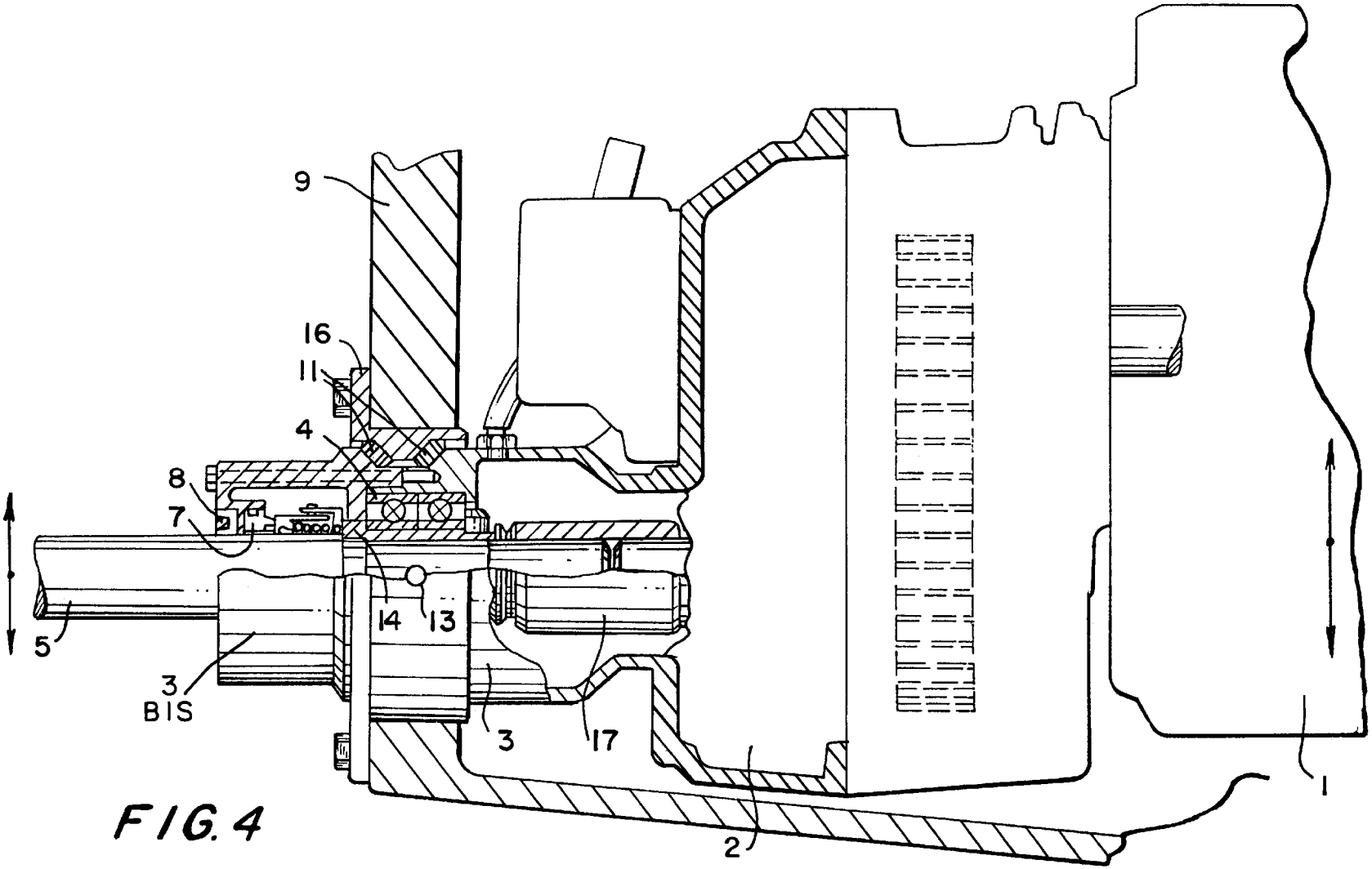
FIG. 4 shows in detail a partial cross section of the hollow cylindrical body integral to the box housing of the reversing gearbox of FIG. 3.
Figure 5:
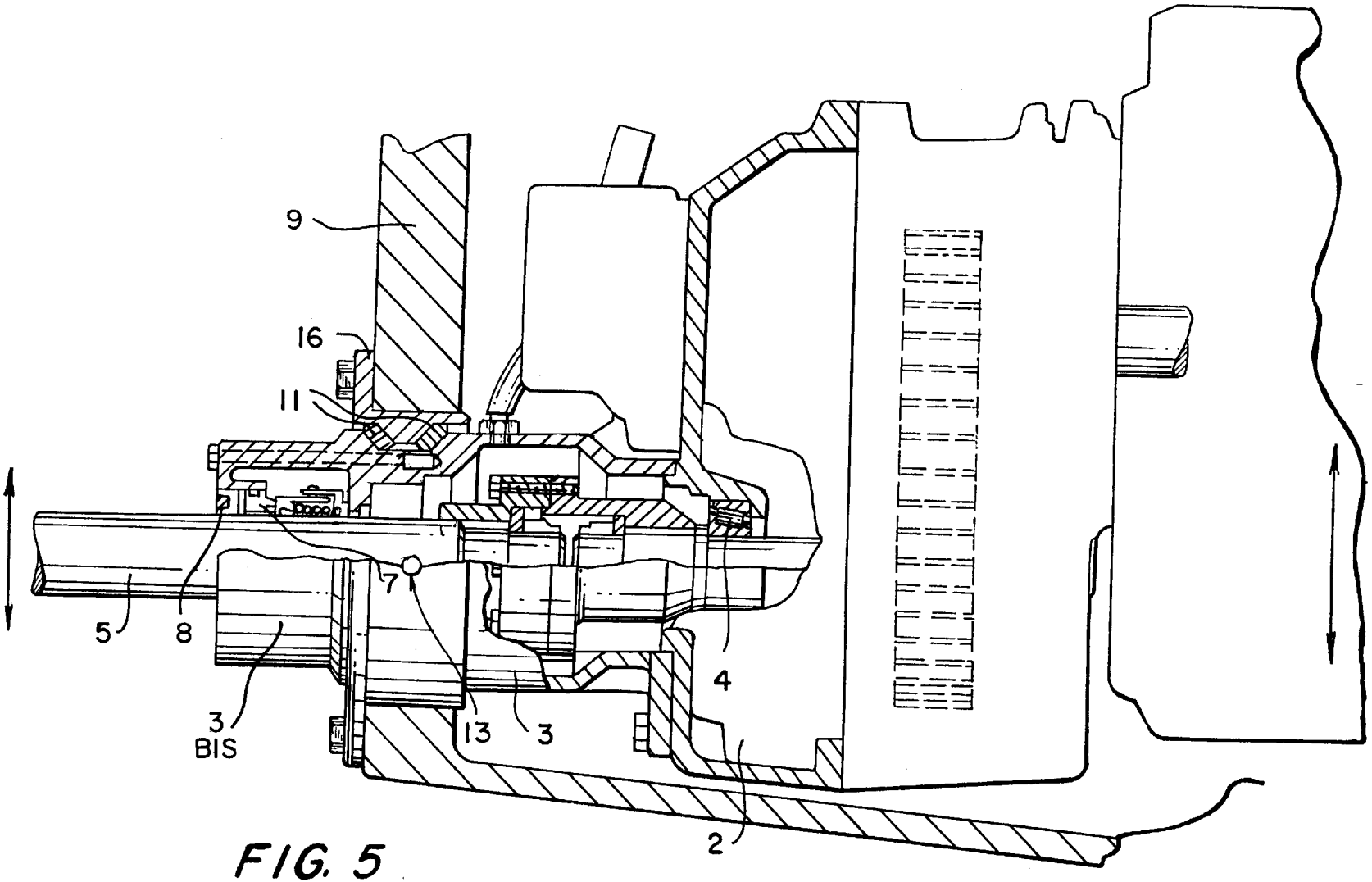
FIG. 5 shows the thrust bearing incorporated in the reversing gearbox.

FIG. 3 shows in more detail and with a partial cross-section the hollow cylindrical body 3 coming out of the stern surface 9. FIG. 3 shows the engine 1 rigidly fixed to the inverter 2 (preferably but not necessarily of the lowered kind, with the inlet and the outlet shafts having different axes in order to allow a lesser inclination of the propeller-supporting shaft 5 with regard to the water surface) and the hollow cylindrical body 3, rigidly fixed to the carter of the inverter 2 or formed all in a single piece with said carter.

In FIG. 3 the hollow cylindrical body 3 was partially sectioned in order to point out the elements placed inside the body. This figure shows a couple of thrust bearings 4 fitted together by means of a bushing 14 on the propeller-supporting shaft 5 which is linked by spline 17 (or by means of known alignment-connecting joint) to the outlet shaft of the reversing gearbox.

According to a further embodiment of the present invention, not described in the figures, the thrust bearing 4 is incorporated in the inverter 2 and the propeller-supporting shaft 5 is rigidly linked to the outlet shaft of the inverter 2.

The propeller-supporting shaft 5 is all in a single piece with the hollow cylindrical body 3, the inverter 2 and the engine 1. This represents a characteristic of the invention, which definitely distinguishes it from the known kinetic chains.

Inside the hollow cylindrical body 3 are also placed mechanical sealing means 7 and/or seals 8, not shown because they are already known and do not belong to the present invention.

The hydraulic sealing is assured by a couple of rubber rings 11 (preferably but not necessarily of the "O-ring" kind) placed between the external surface of the hollow cylindrical body 3 and a toroidal element 16 applied to a corresponding hole in the stern surface 9 in order to allow the propeller-supporting shaft 5 to come out of the boat. The toroidal element 16 is fixed to the stern surface 9 by means of bolts or other equivalent and reversible fastening means.

Beside assuring the hydraulic sealing, the elasticity of the rubber rings 11 allows the "single piece" formed by the propeller-supporting shaft 5, the cylindrical body 3, the inverter 2 and the engine 1 to oscillate around a virtual rotation shaft (referred to with number 13 in FIG. 3). Therefore it is possible to adjust the inclination of the propeller-supporting shaft 5 (and, consequently, the position of the propeller 7) with regard to the water surface acting on the adjustable support 6 and on the adjustable feet 15 (FIG. 2) supporting engine 1.

In order to facilitate the assembly and the maintenance of the hollow cylindrical body 3 supporting the propeller-supporting shaft 5, the hollow cylindrical body 3 is preferably formed by two parts (3, 3bis) linked to each other by means of bolts or other equivalent and reversible fastening means.

Without sorting from the scope of the present invention, it is possible to use only one thrust bearing 4 and/or only one rubber ring 11 and fit the thrust bearing or bearings 4 directly on the propeller-supporting shaft 5.

In the embodiment shown in FIG. 3, the internal surface of the toroidal element 16 has a trapezoidal profile and the two rubber rings 11 are placed between the sides of said trapezoidal profile and two surfaces which are complementary to said sides on the external surface of the hollow cylindrical body 3.

Without sorting from the scope of the invention, a man skilled in the art can introduce in the simplified propelling system with propeller drive object of the present invention all modifications and improvements suggested by the experience and by the natural evolution of technology.

I claim:

1. Simplified propelling system for a boat with propeller drive, comprising at least an engine, a reversing gearbox, having a box housing and an outlet shaft, solidly linked to said engine, a propeller-supporting shaft carried by an adjustable support placed outside the boat and means to transmit the motion from said reversing gearbox to said shaft supporting said propeller, said propelling system comprising, combined together:

a hollow cylindrical body rigidly fixed to the box housing of said reversing gearbox;

at least a thrust bearing, placed inside said hollow cylindrical body and fitted on said propeller-supporting shaft;

at least a rubber ring placed between the external surface of said hollow cylindrical body and a toroidal element applied to a corresponding hole in the stern surface of said boat;

wherein said propeller-supporting shaft is spline-linked to the outlet shaft of said reversing gearbox and said engine is supported by adjustable feet.

2. Propelling system according to claim 1, wherein said at least one thrust bearing is fitted on said propeller-supporting shaft by means of a bushing.

3. Propelling system according to claim 1, wherein said at least one rubber ring is of the "O-ring" kind.

4. Propelling system according to claim 1, wherein said hollow cylindrical body is integral to said box housing of said reversing gearbox.

5. Propelling system according to claim 1, wherein said propeller-supporting shaft is a single assembly with said hollow cylindrical body, said reversing gearbox and said engine.

6. Propelling system according to claim 1, wherein said hollow cylindrical body is formed by two parts linked to each other by reversible fastening means.

7. Simplified propelling device system for a boat with propeller drive, comprising at least an engine, a reversing gearbox, having a box housing and an outlet shaft, solidly linked to said engine, a propeller-supporting shaft carried by an adjustable support placed outside the boat and means to transmit the motion from said reversing gearbox to said shaft supporting said propeller, said propelling system comprising, combined together:

a hollow cylindrical body rigidly fixed to the box housing of said reversing gearbox;

at least a thrust bearing incorporated in said reversing gearbox;

at least a rubber ring placed between the external surface of said hollow cylindrical body and a toroidal element applied to a corresponding hole in the stern surface of said boat;

wherein said propeller-supporting shaft is rigidly linked to the outlet shaft of said reversing gearbox and said engine is supported by an adjustable feet.

8. Propelling system according to claim 7, wherein said at least one rubber ring is of the "O-ring" kind.

9. Propelling system according to claim 7, wherein said hollow cylindrical body is integral to said box housing of said reversing gearbox.

10. Propelling system according to claim 7, wherein said propeller-supporting shaft is a single assembly with said hollow cylindrical body, said reversing gearbox and said engine.

11. Propelling system according to claim 7, wherein said hollow cylindrical body is formed by two parts linked to each other by reversible fastening means.

12. Simplified propelling system for a boat with propeller drive, comprising at least an engine, a reversing gearbox, having a box housing and an outlet shaft, solidly linked to said engine, a propeller-supporting shaft carried by an adjustable support placed outside the boat and means to transmit the motion from said reversing gearbox to said shaft supporting said propeller, said propelling system comprising, combined together:

a hollow cylindrical body rigidly fixed to the box housing of said reversing gearbox;

at least a thrust bearing, placed inside said hollow cylindrical body and fitted on said propeller-supporting shaft;

at least a rubber ring placed between the external surface of said hollow cylindrical body and a toroidal element applied to a corresponding hole in the stern surface of said boat;

wherein said propeller-supporting shaft is linked to the outlet shaft of said reversing gearbox and said engine is supported by adjustable feet.

* * * * *